US011193355B2

(12) United States Patent
Steele

(10) Patent No.: US 11,193,355 B2
(45) Date of Patent: Dec. 7, 2021

(54) ACTUATOR FOR MULTILATERAL WELLBORE SYSTEM

(71) Applicant: Halliburton Energy Services, Inc., Houston, TX (US)

(72) Inventor: David Joe Steele, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/094,429

(22) PCT Filed: Nov. 17, 2017

(86) PCT No.: PCT/US2017/062406
§ 371 (c)(1),
(2) Date: Oct. 17, 2018

(87) PCT Pub. No.: WO2019/099038
PCT Pub. Date: May 23, 2019

(65) Prior Publication Data

US 2021/0010349 A1 Jan. 14, 2021

(51) Int. Cl.
*E21B 41/00* (2006.01)
*E21B 23/04* (2006.01)
(Continued)

(52) U.S. Cl.
CPC ..... *E21B 41/0035* (2013.01); *E21B 23/04* (2013.01); *E21B 34/06* (2013.01);
(Continued)

(58) Field of Classification Search
CPC ..... E21B 41/0042; E21B 23/12; E21B 34/14; E21B 2200/06; E21B 43/305; E21B 41/0035; E21B 23/04; E21B 34/06
See application file for complete search history.

(56) References Cited

U.S. PATENT DOCUMENTS 5,520,255 A 5/1996 Barr et al.
5,730,224 A 3/1998 Williamson et al.
(Continued)

OTHER PUBLICATIONS

"Inchworm Motor" retrieved from en.wikipedia.org/wiki/Inchworm_motor.

(Continued)

*Primary Examiner* — Nicole Coy
(74) *Attorney, Agent, or Firm* — Scott Richardson; C. Tumey Law Group PLLC

(57) ABSTRACT

A lateral wellbore access system is used for moving an isolation sleeve relative to a window of a completion sleeve to adjust access through the window. The system includes an actuator having an isolation sleeve engagement mechanism and a driving mechanism. The isolation sleeve engagement mechanism is configured to engage with an isolation sleeve. The driving mechanism is configured to longitudinally reciprocate the isolation sleeve relative to the isolation sleeve engagement mechanism within a bore of a completion sleeve to longitudinally move an isolation sleeve within the bore relative to a window of the completion sleeve. Movement of the isolation sleeve adjusts a position of the isolation sleeve relative to the completion sleeve window for permitting or blocking access through the window into the bore.

20 Claims, 7 Drawing Sheets

(51) Int. Cl.
*E21B 34/06* (2006.01)
*E21B 33/12* (2006.01)

(52) U.S. Cl.
CPC ..... *E21B 41/0042* (2013.01); *E21B 33/12* (2013.01); *E21B 2200/06* (2020.05)

(56) References Cited

U.S. PATENT DOCUMENTS

| | | | | |
|---|---|---|---|---|
| 6,244,340 | B1 | 6/2001 | McGlothen et al. | |
| 6,321,845 | B1 | 11/2001 | Deaton | |
| 6,364,023 | B1 | 4/2002 | Hiron et al. | |
| 6,433,991 | B1 | 8/2002 | Deaton et al. | |
| 7,675,253 | B2 | 3/2010 | Dorel | |
| 7,762,324 | B2 * | 7/2010 | Clem | E21B 43/045 166/177.5 |
| 8,157,016 | B2 * | 4/2012 | James | E21B 23/04 166/375 |
| 8,159,114 | B2 | 4/2012 | Rahman et al. | |
| 8,316,937 | B2 | 11/2012 | Cronley et al. | |
| 8,459,345 | B2 | 4/2013 | Bell | |
| 8,636,054 | B2 | 1/2014 | Smithson et al. | |
| 8,789,580 | B2 | 7/2014 | Dancer et al. | |
| 8,813,840 | B2 | 8/2014 | Zupanick | |
| 9,238,949 | B2 * | 1/2016 | Dancer | E21B 7/061 |
| 10,557,331 | B2 * | 2/2020 | Rodriguez | E21B 41/0042 |
| 10,724,344 | B2 * | 7/2020 | Dietz | E21B 7/061 |
| 2009/0255687 | A1 | 10/2009 | McCullough et al. | |
| 2011/0147086 | A1 | 6/2011 | Hummes et al. | |
| 2011/0186291 | A1 * | 8/2011 | Lang | E21B 47/024 166/255.2 |
| 2011/0259641 | A1 | 10/2011 | Khadrbiek et al. | |
| 2012/0241144 | A1 | 9/2012 | Bell | |
| 2014/0034298 | A1 | 2/2014 | Donovan | |
| 2014/0124198 | A1 | 5/2014 | Donovan | |
| 2014/0251628 | A1 * | 9/2014 | Wilkin | E21B 34/14 166/318 |

OTHER PUBLICATIONS

"MaxTRAC Downhole Wireline Tractor System" retrieved from slb.com/services/production/production_logging/conveyance/maxtrac_downhole_well_tractor.aspx#.

Model 6000 Inchworm Motor Controller Instruction Manual.

"Piezo Motor Solutions for Automation & Precision Motion Control" retrieved from piezo-motor.net/?onl_goog_comp_inchworm&gclid=Cj0KEQiAu_GmBRDhtK-kzqKcuJwBEiQAJvB8n7fDtcXWkPAMUkoQiYriWk1SsyuNkRJdSvEDIITDpH4aAkx08P8HAQ.

"Flexural Brake Mechanism for Inchworm Actuator" Suleman et al. dated 2001.

"Amplification In Inchworm Motors Using Hydraulic Booster: Modeling and Simulation" Morris et al. dated 2002.

"Robot that moves like an inchworm could go places other robots can't" Zyga dated Nov. 10, 2014.

"How do Jackups Work?" retrieved from rigzone.com/training/insight.asp?insight_id=339&c_id=24.

"HS Interval Control Valves" Halliburton dated 2017.

"Six Zone Intelligent Completion Installation Benefits and Lessons Learned Before Production in Offshore Indonesia" Jugdaw et al. dated 2013.

International Search Report and Written Opinion for PCT/US2017/062406 dated Aug. 16, 2018.

* cited by examiner

ACTUATOR FOR MULTILATERAL WELLBORE SYSTEM

TECHNICAL FIELD

The present description relates in general to multilateral wellbore operations, and more particularly to, for example, without limitation, an actuator for shifting an isolation sleeve for multilateral wellbore operations.

BACKGROUND OF THE DISCLOSURE

In the oil and gas industry, hydrocarbons are produced from wellbores traversing subterranean hydrocarbon producing formations. Many current well completions include more than one wellbore. For example, a first, generally vertical wellbore may be initially drilled within or adjacent to one or more hydrocarbon producing formations. Any number of additional wellbores may then be drilled extending generally laterally away from the first wellbore to respective locations selected to optimize production from the associated hydrocarbon producing formation or formations. Such well completions are commonly referred to as multilateral wells.

A typical multilateral well completion includes a primary wellbore defined in part by a string of casing and cement disposed between the casing and the inside diameter of the primary wellbore. The primary wellbore extends from the well surface to a desired downhole location, and directional drilling equipment and techniques may then be used to form one or more exits or windows from the primary wellbore through the casing and cement at predetermined locations and subsequently drill one or more corresponding secondary wellbores that extend from the primary wellbore. For many well completions such as deep offshore wells, multiple secondary wellbores will be drilled from each primary wellbore in an effort to optimize hydrocarbon production while minimizing overall drilling and well completion costs.

BRIEF DESCRIPTION OF THE DRAWINGS

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Accordingly, the drawings and description are to be regarded as illustrative in nature and not restrictive.

Some embodiments disclosed herein provide actuators and methods for shifting an isolation sleeve during multilateral wellbore operations.

Selective isolation and/or reentry into each of the secondary wellbores is often necessary to optimize production from the associated hydrocarbon producing formations. A typical multilateral well completion will have a reentry window assembly (alternately referred to as a lateral reentry window or lateral wellbore access system) installed within the primary wellbore at the junction between the primary wellbore and each secondary wellbore. Each reentry window assembly includes a window that provides access into the secondary wellbore from the primary wellbore. In order to block access through the window and/or to prevent fluid flow through the window, an isolation sleeve must be lowered into the primary wellbore and fitted within the reentry window assembly in a position to block the window. Thereafter, to permit access through the window and allow entry into the secondary wellbore, the isolation sleeve must be located and removed from within the reentry window assembly to expose the window. Conventionally, these isolation sleeves must be completely removed from the primary wellbore to allow access to the secondary wellbore, requiring rig time to conduct intervention runs to retrieve and re-install conventional isolation sleeves.

According to at least some embodiments disclosed herein is the realization that the number of required intervention trips into a multilateral well can be reduced by using a system that includes a reciprocating actuator for shifting an isolation sleeve without requiring the isolation sleeve to be completely removed or otherwise manipulated using tools from the surface. Further, according to at least some embodiments disclosed herein is the realization that by including a reciprocating actuator for shifting an isolation sleeve, the size of the opening through the window can be precisely controlled to regulate the amount of flow from the lateral or secondary wellbore in the multilateral well. Further, according to at least some embodiments disclosed herein is the realization that by including a reciprocating actuator for shifting an isolation sleeve, an overall system length can be reduced within the wellbore.

Figure 1:
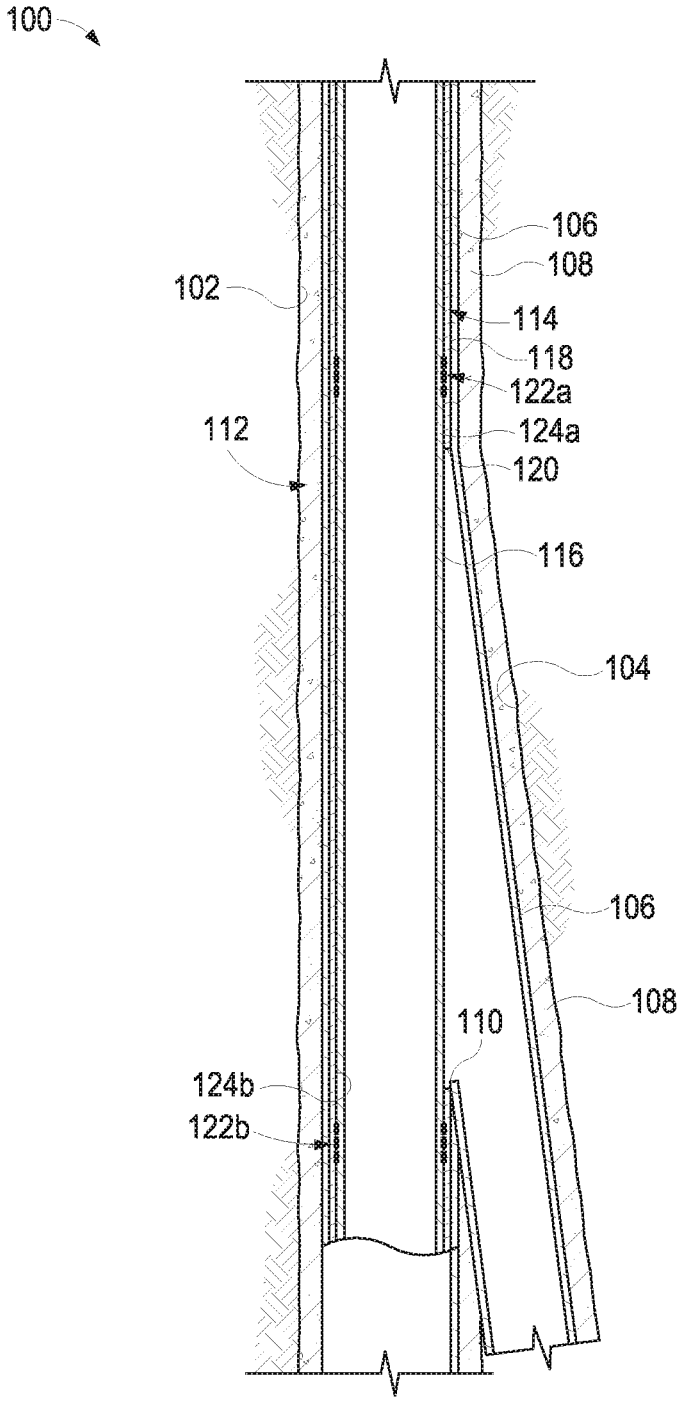
FIG. 1 is a cross-sectional view of an exemplary well system that may incorporate the principles of the present disclosure.

FIG. 1 is a cross-sectional view of an exemplary well system that may be incorporate the principles of the present disclosure. As illustrated, the well system 100 may include a primary wellbore 102 and a secondary wellbore 104 that extends at an angle from the primary wellbore 102. The primary wellbore 102 can alternately be referred to as a parent wellbore, and the secondary wellbore 104 can be referred to as a lateral wellbore. While only one secondary wellbore 104 is depicted in FIG. 1, it will be appreciated that the well system 100 may include multiple secondary (lateral) wellbores 104 extending from the primary wellbore 102 at various locations. Likewise, it will be appreciated that the well system 100 may include multiple tertiary (twig) wellbores (not shown) extending from one or more of the secondary wellbores 104 at various locations. Accordingly, the well system 100 may be characterized and otherwise referred to as a "multilateral" wellbore system.

A liner or casing 106 may line each of the primary and secondary wellbores 102, 104 and cement 108 may be used to secure the casing 106 therein. In some embodiments, however, the casing 106 may be omitted from the secondary wellbore 104, without departing from the scope of the disclosure. In other embodiments, the cement 108 may be omitted from the secondary wellbore 104, without departing from the scope of this disclosure. The primary and secondary wellbores 102, 104, may be drilled and completed using conventional well drilling techniques. A casing exit 110 may be milled, drilled, or otherwise defined along the casing 106 at the junction between the primary and secondary wellbores 102, 104. The casing exit 110 generally provides access for downhole tools to enter the secondary wellbore 104 from the primary wellbore 102.

In the illustrated embodiment, the well system 100 has been completed by installing a reentry window assembly 112, also referred to as a lateral wellbore access system, in the primary wellbore 102. The reentry window assembly 112 includes a completion sleeve 114 and an isolation sleeve 116 longitudinally movably positioned within a bore of the completion sleeve 114. As illustrated, the completion sleeve 114 is able to be positioned within the primary wellbore 102 and provides a generally cylindrical body 118 with a longitudinal axis that axially spans the casing exit 110. The completion sleeve 114 may be arranged within the primary wellbore 102 such that a window 120 defined to provide access to the bore of the completion sleeve 114 azimuthally and angularly aligns with the casing exit 110 and thereby provides access into the secondary wellbore 104 from the primary wellbore 102. In some embodiments, the completion sleeve 114 can include packers, or other sealing devices, disposed at either end of the isolation sleeve 116 to seal off the annulus defined by the completion sleeve 114 and the primary wellbore 102. Packers or other sealing devices can work in conjunction with the isolation sleeve 116 to prevent flow to and/or from the secondary wellbore 104 to the primary wellbore 102.

Figure 2:
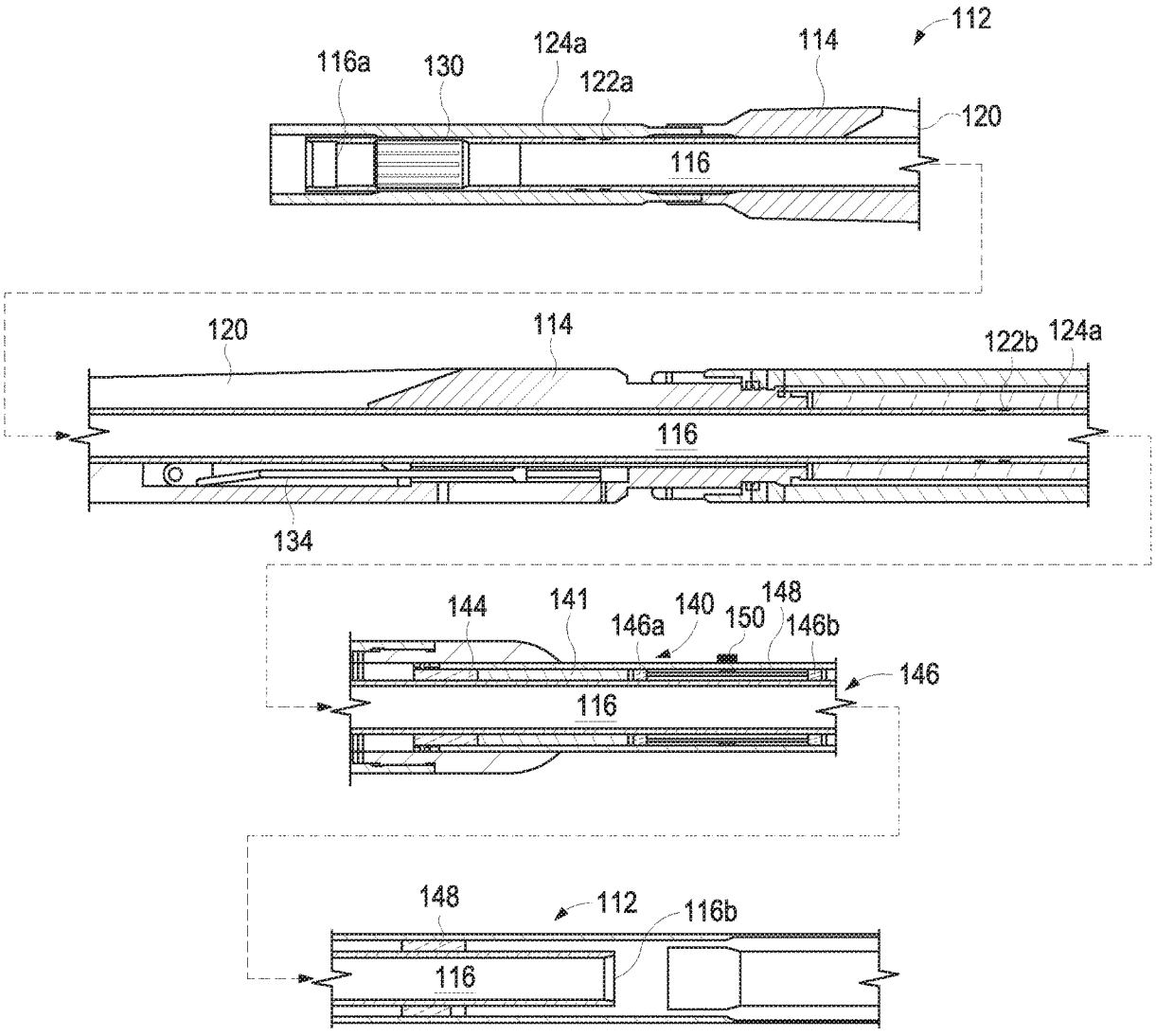
FIG. 2 is a cross-sectional side view of an exemplary reentry window assembly according to some embodiments.

FIG. 2 is a cross-sectional side view of an exemplary reentry window assembly according to some embodiments of the present disclosure. More particularly, FIG. 2 depicts successive portions of the reentry window assembly 112. Similar reference numerals used in prior figures will refer to similar elements or components that may not be described again in detail.

In some embodiments, the isolation sleeve 116 may be positioned within the body 118 of the completion sleeve 114 and may comprise a generally tubular or cylindrical structure that is axially movable within the completion sleeve 114 between a first or "fully closed" position, a second or "fully open" position, or any position therebetween.

In some embodiments, as in the example of FIG. 2, the reentry window assembly 112 can optionally include a set of upper seals 122*a* and a set of lower seals 122*b* to seal between the completion sleeve 114 and the isolation sleeve 116. The upper seals 122*a* and the lower seals 122*b* are optionally carried on the isolation sleeve 116. The upper seals 122*a* may sealingly engage an upper seal bore 124*a* provided on the inner surface of the body 118, and the lower seals 122*b* may sealingly engage a lower seal bore 124*b* provided on the inner surface of the body 118. As illustrated, the upper and lower seal bores 124*a*, 124*b* are located adjacent opposing axial ends of the window 120. Accordingly, when in the first position, the isolation sleeve 116 may provide fluid isolation between the primary and secondary wellbores 102, 104.

According to some embodiments, the isolation sleeve 116 can be axially translated by an actuator 140. In some embodiments, the actuator 140 can be disposed at an uphole location relative to the isolation sleeve 116. In some embodiments, the actuator 140 can be disposed at a downhole location relative to the isolation sleeve 116. In some embodiments, the actuator 140 can be disposed in between the upper seals 122*a* and the lower seals 122*b* of the isolation sleeve 116.

In some embodiments, the isolation sleeve 116 is releasably engaged to the actuator 140 via an isolation sleeve engagement mechanism 146 to selectively allow movement of the isolation sleeve 116 relative to the actuator 140 to either allow movement of the isolation sleeve 116 attributed to the actuator 140 or for allowing the isolation sleeve 116 to be removed from the wellbore via a retrieval tool.

In some embodiments, the isolation sleeve engagement mechanism 146 includes engagement members 146*a*, 146*b* (also referred to as clutches) to selectively engage the isolation sleeve 116. The engagement members 146*a*, 146*b* are coupled to a movement member 148 to allow selective axial movement of each engagement member 146*a*, 146*b*, facilitating translation of the isolation sleeve 116 as described herein.

The engagement members 146*a*, 146*b* can comprise clutches or other devices that can each engage the isolation sleeve 116 to prevent movement of the isolation sleeve 116 relative to the respective engagement member 146*a*, 146*b* when engaged, and allow movement past the engagement member 146*a*, 146*b* when disengaged. For example, in some embodiments, the engagement members 146*a*, 146*b* can comprise piezo actuators to facilitate engagement. Further, in some embodiments, the engagement members 146*a*, 146*b* can be part of an "inchworm" motor, whose operation is reliant on the successive engagement and disengagement of clutches and intermittent advancement of the workpiece or part being moved. For example, in some embodiments, the engagement member 146*b* can be engaged with the isolation sleeve 116 while the engagement member 146*a* is disengaged and the actuator 140 can move or translate the isolation sleeve 116 by advancing the engagement member 146*b* relative to the engagement member 146*a*. Subsequently, the engagement members 146*a* can be engaged the isolation sleeve 116 to maintain the longitudinal position of the isolation sleeve 116 while the engagement member 146*b* disengages and move back to its original position. Thereafter, the process can be repeated to incrementally move the isolation sleeve 116. Furthermore, if both the engagement members 146*a*, 146*b* are disengaged from the isolation sleeve 116, the isolation sleeve 116 can move freely with respect to the actuator 140, which can be useful when the isolation sleeve 116 is placed or removed from the system.

The engagement members 146*a*, 146*b* can be axially disposed within the body 141 to receive the isolation sleeve 116 therebetween. In some embodiments, the engagement members 146*a*, 146*b* are at least partially radially disposed within the body 141 and can allow movement of the isolation sleeve 116 through the engagement members 146*a*, 146*b* when disengaged.

The engagement members 146*a*, 146*b* can engage the isolation sleeve 116 by extending or radially expanding until sufficient frictional contact or profile engagement is made to retain the isolation sleeve 116 relative to the respective engagement member 146*a*, 146*b*. In some embodiments, the engagement members 146*a*, 146*b* can include gear teeth to engage a toothed profile of the isolation sleeve 116. The engagement members 146*a*, 146*b* can be driven by hydraulic actuation, pneumatic actuation, piezo actuation, electromechanical actuation, or any combination thereof.

During operation, an operator may desire to retrieve the isolation sleeve 116 for replacement or servicing. In some embodiments, a retrieval or intervention tool can be deployed downhole to locate the isolation sleeve 116. The retrieval tool can engage an engagement device 130 located at the upper end 116*a* of the isolation sleeve 116. The engagement device 130 can comprise a snap collet that includes a plurality of flexible collet fingers. In some embodiments, the retrieval tool can include spring-loaded dogs or keys that compress when entering the isolation sleeve 116 and expand outwardly to engage a profile of the isolation sleeve 116. In some embodiments, an inner mandrel can slide under the dogs to lock the retrieval tool in place. In other embodiments, however, the engagement device 130 may comprise any type of mechanism capable of releasably engaging a retrieval tool. In some embodiments, the engagement members 146*a*, 146*b* can release the isolation sleeve 116 from the actuator 140 to allow the isolation sleeve 116 to be retrieved by the retrieval tool. In some embodiments, the retrieval tool can overcome a required axial force to release the isolation sleeve 116 from an engagement member 146*a*, 146*b*.

According to some embodiments, the movement of the actuator 140 can move the isolation sleeve 116 to reciprocate the isolation sleeve 116 within the bore of the completion sleeve 114. The position of the isolation sleeve 116 can be determined and/or controlled using a position sensor 150.

Figure 3:
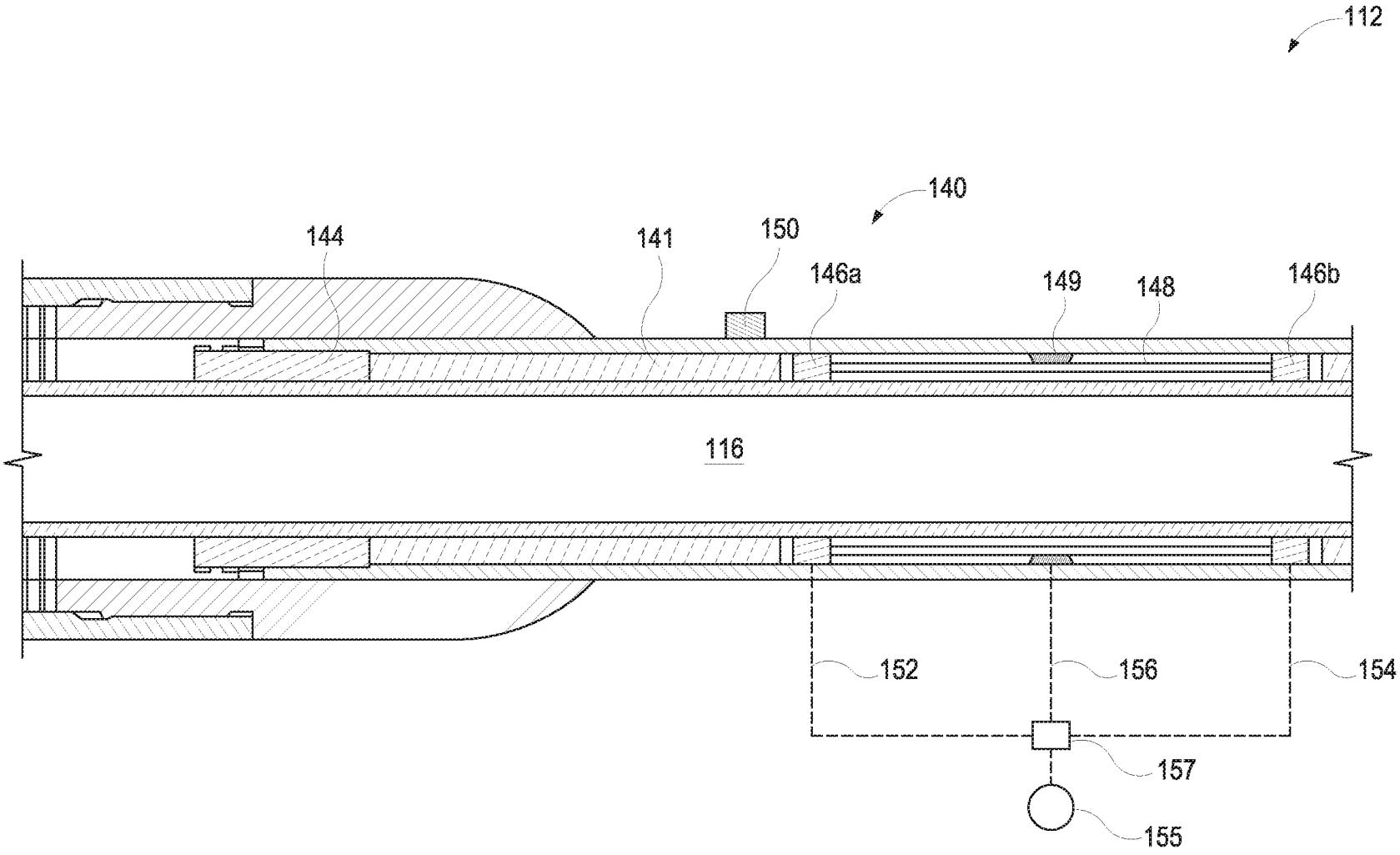
FIG. 3 is a cross-sectional side view of an exemplary actuator according to some embodiments.

FIG. 3 is a cross-sectional side view of an exemplary actuator according to some embodiments of the present disclosure. In some embodiments, the movement member 148 (also referred to as a driving mechanism), is affixed to the body 141 of the actuator 140 via a mount 149. The movement member 148 can axially expand, contract, or otherwise reciprocate about the mount 149 and relative to the isolation sleeve 116. For example, the movement member 148 can expand and contract to move the engagement members 146*a*, 146*b* to reciprocate the isolation sleeve 116 within the bore of the completion sleeve 114. During actuation, the operation of the engagement members 146*a*, 146*b* and the movement member 148 can be in concert to allow translation or reciprocation of the isolation sleeve 116.

As noted above, in some embodiments, the actuator 140 can utilize "inchworm" actuation. For example, the movement member 148 can reciprocate about the mount 149 and selectively engage and disengage the engagement members 146*a*, 146*b* to allow the isolation sleeve 116 to be moved in a desired axial direction, without an overall positional displacement of the actuator 140 relative to the reentry window assembly 112.

For example, to axially translate the isolation sleeve 116 towards a first end 144 of the actuator 140, the first engagement member 146*a* is engaged against the isolation sleeve 116 to initialize movement toward the first end, then (1) the movement member 148 is axially extended, (2) the second engagement member 146*b* is engaged against the isolation sleeve 116, (3) the first engagement member 146*a* is disengaged, (4) the movement member 148 is axially contracted, (5) the first engagement member 146*a* is engaged against the isolation sleeve 116, and (6) the second engagement member 146*b* is disengaged. To move the isolation sleeve 116 further in a same direction, this process can be repeated until a desired isolation sleeve position is achieved. This movement of the movement member 148 and engagement members 146*a*, 146*b* can thereby move the isolation sleeve relative to the window 120 to reduce or increase the size of the opening through the window 120.

Similarly, to axially translate the isolation sleeve 116 towards a second end 148 of the actuator 140, the second engagement member 146*b* is engaged against the isolation sleeve 116 to initialize movement toward the second end, then (1) the movement member 148 is axially extended, (2) the first engagement member 146*a* is engaged against the isolation sleeve 116, (3) the second engagement member 146*b* is disengaged, (4) the movement member 148 is axially contracted, (5) the second engagement member 146*b* is engaged against the isolation sleeve 116, and (6) the first engagement member 146*a* is disengaged. To move the isolation sleeve 116 further in a same direction, this process can be repeated until a desired isolation sleeve position is achieved. This movement of the movement member 148 and engagement members 146*a*, 146*b* can thereby move the isolation sleeve relative to the window 120 to increase the size of the opening through the window 120 to adjust flow area (see FIGS. 4A-4C).

In some embodiments, the movement member 148 and the engagement members 146*a*, 146*b* can be pneumatically, electrically, or hydraulically operated. Further, in some embodiments, the operation of the movement member 148 and the engagement members 146*a*, 146*b* can be controlled by a sequencing valve system. For example, in some embodiments, the movement member 148 and engagement members 146*a*, 146*b* are hydraulically operated by hydraulic pressure provided by a hydraulic pump 155. A hydraulic sequencing valve system 157 can provide selective fluid pressure via lines 152, 154, and 156 to the engagement members 146*a*, 146*b* and the movement member 148 respectively. The hydraulic system can be a closed hydraulic system. In some embodiments, the movement member 148 and the engagement members 146*a*, 146*b* can be electromechanically operated. Further, in some embodiments, the operation of the movement member 148 and the engagement members 146*a*, 146*b* can be controlled by a sequencing controller. In some embodiments, additional sensors, switches, indicators, controllers (programmable logic controllers, computers, or other logical systems), etc., can be utilized to aid in proper sequencing of the actuator 140.

Figure 4A:
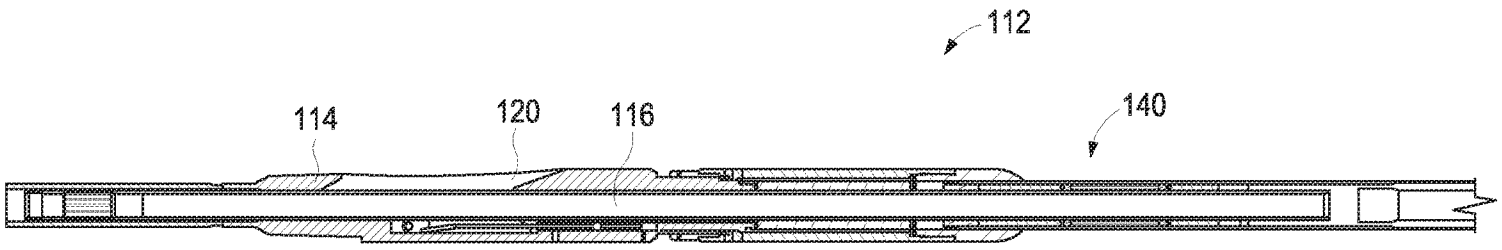
FIGS. 4A-4C are successive cross-sectional side views of the assembly of FIG. 2 in various stages of actuation, according to some embodiments.

According to some embodiments, the movement of the actuator 140 can be used to adjust the amount of overlap of the isolation sleeve 116 with the window 120 to selectively block or allow access to the window 120 of the completion sleeve 114 entirely or partially, at any size opening to regulate the flow of fluid into the production tubing. In some embodiments, movement of the actuator 140 can be used to regulate flow out of the tubing into the lateral wellbore when fluid is to be injected into the wellbore. FIG. 4A is a cross-sectional side view of the assembly of FIG. 2 wherein the isolation sleeve is blocking access to the window. In some embodiments, the isolation sleeve 116 is shown in a first position, wherein the isolation sleeve 116 is occluding the window 120 and thereby prevents access into the secondary wellbore 104 from the primary wellbore 102. As described herein, the isolation sleeve 116 can include seals to provide fluid isolation between the primary and secondary wellbores 102, 104.

Figure 4B:
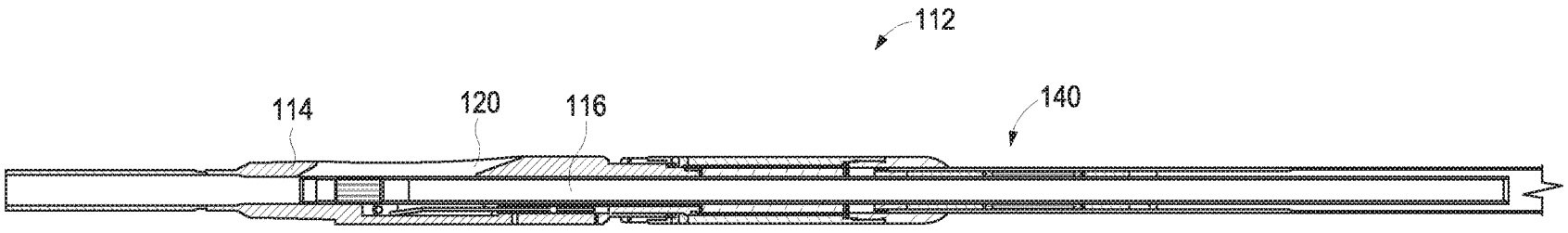

FIG. 4B is a cross-sectional side view of the assembly of FIG. 2 wherein the isolation sleeve is partially blocking access to the window. In some embodiments, the actuator 140 is engaged to direct the isolation sleeve 116 towards a downhole location. The actuator 140 moves the isolation sleeve 116 downhole to partially allow or block the window 120. In some embodiments, partially blocking the window 120 can be used to allow selective, partial, or controlled flow through a lateral wellbore.

Figure 4C:
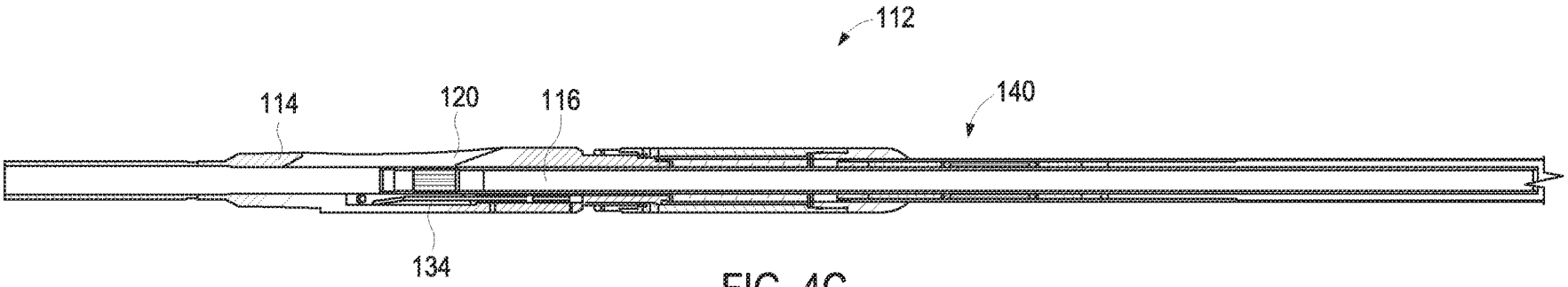

FIG. 4C is a cross-sectional side view of the assembly of FIG. 2 wherein the isolation sleeve is permitting access to the window. In some embodiments, the isolation sleeve 116 is shown in a second position, wherein the isolation sleeve 116 is fully exposing the window 120. In this second position, full access to the lateral wellbore is allowed and any flow or tools are allowed to pass therethrough. In some embodiments, a deflector 134 can be engaged or actuated to direct downhole tools to the secondary wellbore 104 when the isolation sleeve 116 exposes the window 120.

Figure 5:
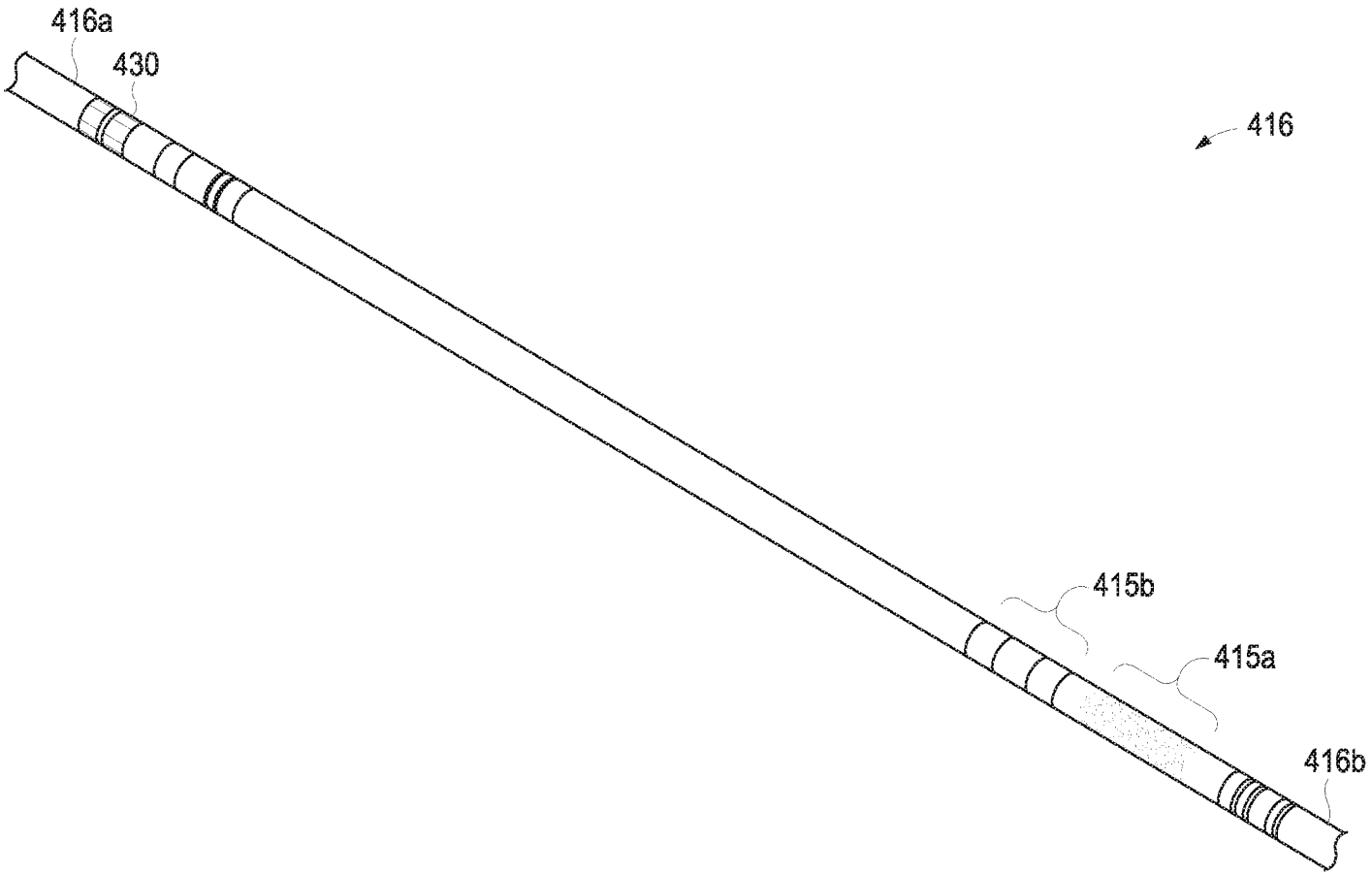
FIG. 5 is an isometric view of an isolation sleeve according to some embodiments.

According to some embodiments, an isolation sleeve can include actuation profiles to facilitate positive engagement between the isolation sleeve and the engagement members 146*a*, 146*b* of the actuator 140. FIG. 5 is an isometric view of an isolation sleeve according to some embodiments of the present disclosure. In some embodiments, the isolation sleeve 416 includes actuation profiles 415*a* and 415*b*. For example, the isolation sleeve 416 can include a friction modified area 415*a* with a higher friction coefficient to allow for greater axial force transfer during movement of the isolation sleeve 416. A grooved area 415*b* can be utilized to allow for engagement members 146*a*, 146*b* to engage grooves to prevent unintended axial movement. Further, gears or other engagement members can engage the grooved areas 415*b* to translate the isolation sleeve 416.

According to some embodiments, the actuator 140 can be utilized to control the position of the isolation sleeve 116 to control the flow to or from the lateral wellbore. The actuator 140 can control the position of the isolation sleeve 116 to partially obstruct the window 120 as shown in FIG. 4B.

Figure 6:
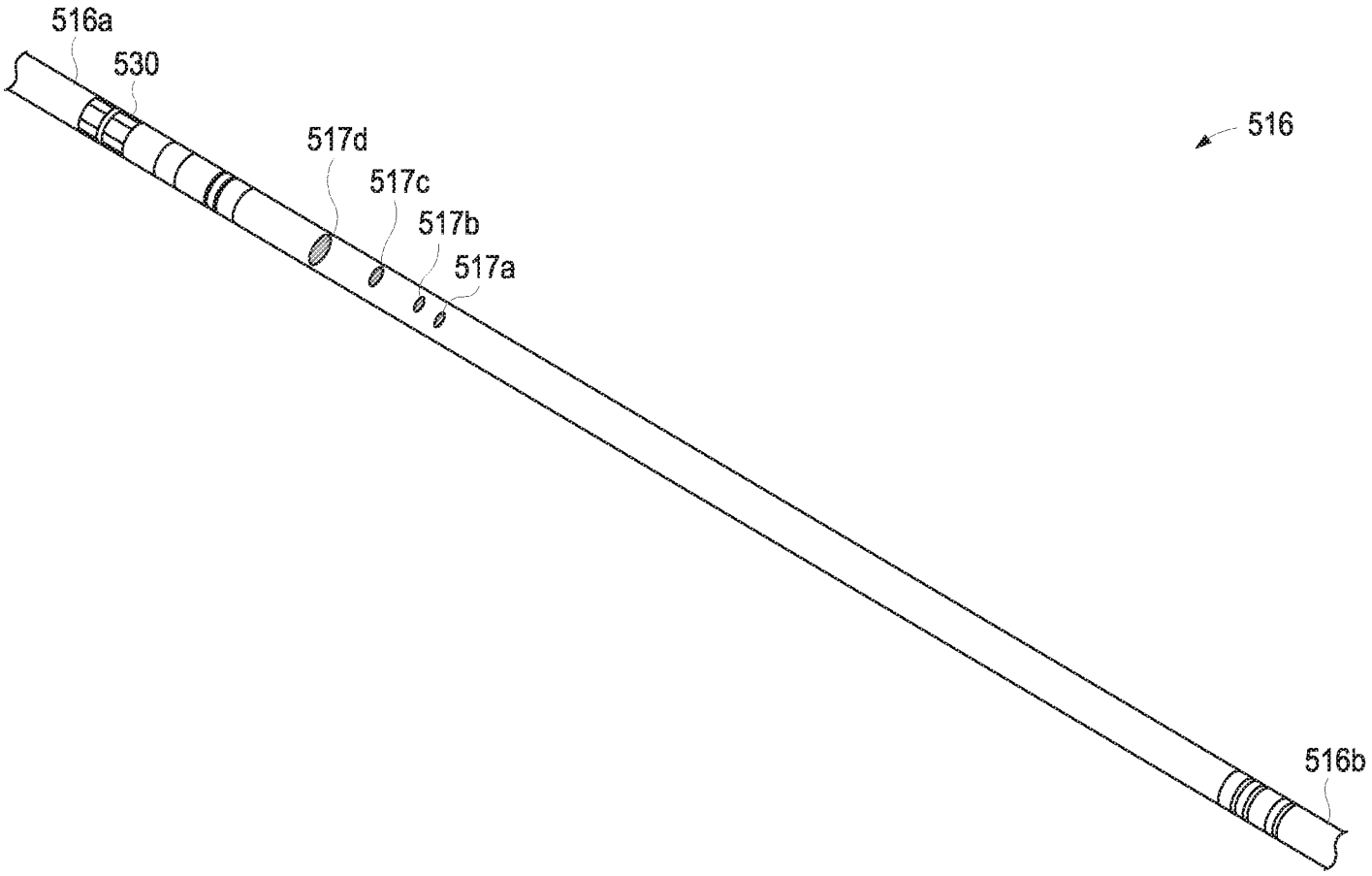
FIG. 6 is an isometric view of an isolation sleeve according to some embodiments.

Further, according to some embodiments, an isolation sleeve can include flow control orifices to choke or restrict flow as various orifices are exposed to the window 120. FIG. 6 is an isometric view of an isolation sleeve according to some embodiments of the present disclosure. In some embodiments, the isolation sleeve 516 includes various flow control orifices 517*a*-517*d*. In some embodiments, the flow control orifices 517*a*-517*d* can be same or varying size orifices that allow a predetermined amount of flow or pressure drop therethrough. Therefore, as various flow control orifices 517*a*-517*d* are exposed to the window 120, a desired amount of flow is allowed through the window 120 while the isolation sleeve 516 is axially disposed across the window 120.

Figure 7:
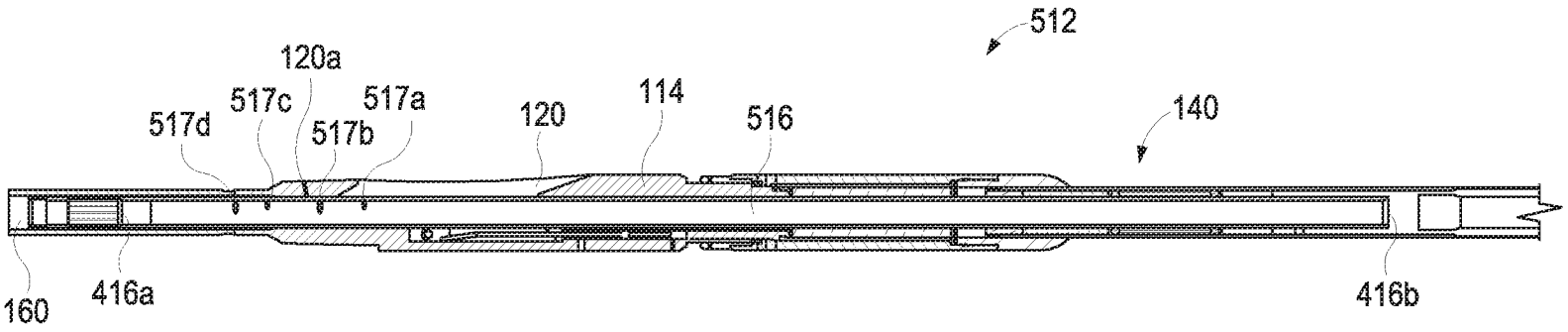
FIG. 7 is a cross-sectional side view of an exemplary reentry window assembly according to some embodiments.

FIG. 7 is a cross-sectional side view of an exemplary reentry window assembly according to some embodiments of the present disclosure. In some embodiments, the actuator 140 can translate the isolation sleeve 516 to control flow through the window 120. By selectively translating the isolation sleeve 516, various flow control orifices 517*a*-517*d* are exposed to the window 120 allowing for varying amounts of flow therethrough. Further, the actuator 140 can translate the isolation sleeve 516 to move the upper end 516*a* of the isolation sleeve 516 past an upper end of the window 120 to partially or fully expose the window 120. In some embodiments, the actuator 140 can translate the upper end 516*a* past a flow control orifice 120*a* formed in the completion sleeve 114 to allow varying amounts of flow therethrough.

In addition to controlling flow via the actuator 140 in conjunction with the isolation sleeve 516*a*, a flow control valve 160 can be used to regulate flow passing through the wellbore system. The flow control device 160 can be controlled according to preprogrammed logic or an operator. In some embodiments, the use of the actuator 140 with the isolation sleeve 516*a* can be used in conjunction with the flow control valve 160. In some embodiments, the use of the actuator 140 with the isolation sleeve 516*a* can replace the use of the flow control valve 160. In some embodiments, the actuator 140 with the isolation sleeve 516*a* can be used for primary flow control purposes while the flow control valve 160 can be used for certain contingencies, including if control of the actuator 140 or the isolation sleeve 416*a* is compromised that places the isolation sleeve 516*a* in a "closed" or "emergency-close" position. In some embodiments, the flow control valve 160 can provide flow control operations when the isolation sleeve 416*a* is in such a closed position.

Various examples of aspects of the disclosure are described below as clauses for convenience. These are provided as examples, and do not limit the subject technology.

Clause 1. A lateral wellbore access system for moving an isolation sleeve relative to a window of a completion sleeve to adjust access through the window, comprising: an actuator having an isolation sleeve engagement mechanism and a driving mechanism, the isolation sleeve engagement mechanism configured to engage with an isolation sleeve, the driving mechanism configured to longitudinally reciprocate the isolation sleeve relative to the isolation sleeve engagement mechanism within a bore of a completion sleeve to longitudinally move an isolation sleeve within the bore relative to a window of the completion sleeve to adjust an amount of longitudinal overlap between the isolation sleeve and the completion sleeve window for permitting or blocking access through the window into the bore.

Clause 2. The system of Clause 1, further comprising a completion sleeve having a longitudinal axis, a bore, and a window extending at least partially along the longitudinal axis to provide access to the bore.

Clause 3. The system of any preceding Clause, further comprising an isolation sleeve positioned within the bore of the completion sleeve, the isolation sleeve being longitudinally movable within the bore to adjust an amount of longitudinal overlap between the isolation sleeve and the completion sleeve window for permitting or blocking access through the window into the bore a first position, wherein the isolation sleeve occludes the window, and a second position, wherein the isolation sleeve is moved axially within the completion sleeve to expose the window.

Clause 4. The lateral wellbore access system of Clause 3, wherein the isolation sleeve comprise an upper seal to sealingly engage the completion sleeve uphole of the window when the isolation sleeve blocks access through the window into the bore.

Clause 5. The lateral wellbore access system of Clause 3, wherein the isolation sleeve comprises a lower seal to sealingly engage the completion sleeve downhole of the window when the isolation sleeve blocks access through the window into the bore.

Clause 6. The downhole apparatus of Clause 3, wherein the isolation sleeve comprise an upper seal to sealingly engage the completion sleeve uphole of the window and a lower seal to sealingly engage the completion sleeve downhole of the window when the isolation sleeve blocks access through the window into the bore.

Clause 7. The downhole apparatus of Clause 6, wherein the actuator is disposed between the upper seal and the lower seal.

Clause 8. The lateral wellbore access system of any preceding Clause, wherein the isolation sleeve engagement mechanism comprises a first clutch and a second clutch, and the driving mechanism movably couples the first clutch and the second clutch.

Clause 9. The lateral wellbore access system of Clause 8, wherein the isolation sleeve passes through the first clutch and the second clutch to adjust the amount of longitudinal overlap.

Clause 10. The lateral wellbore access system of Clause 9, wherein the second clutch is axially disposed relative to the first clutch and the first clutch and the second clutch are configured to receive the isolation sleeve therebetween.

Clause 11. The lateral wellbore access system of any preceding Clause, wherein the driving mechanism comprises a hydraulic driving mechanism.

Clause 12. The downhole apparatus of Clause 11, wherein the hydraulic driving mechanism comprises a sequential valve system for actuating a movement member, a first clutch, and a second clutch.

Clause 13. The lateral wellbore access system of Clause 11, wherein the hydraulic mechanism comprises a closed hydraulic system.

Clause 14. The downhole apparatus of any preceding Clause, wherein the actuator comprises a pneumatic actuator.

Clause 15. The downhole apparatus of Clause 15, wherein the pneumatic actuator comprises a sequential valve system for actuating to a movement member, a first clutch, and a second clutch.

Clause 16. The downhole apparatus of any preceding Clause, wherein the isolation sleeve comprises an actuation profile.

Clause 17. The downhole apparatus of Clause 16, wherein at least one of a first clutch and a second clutch engages the actuation profile.

Clause 18. The lateral wellbore access system of any preceding Clause, further comprising a deflector disposed downhole of the window.

Clause 19. The lateral wellbore access system of any preceding Clause, wherein the isolation sleeve engagement mechanism comprises a latch key assembly.

Clause 20. The lateral wellbore access system of any preceding Clause, wherein the actuator is disposed downhole of the isolation sleeve.

Clause 21. The lateral wellbore access system of any preceding Clause, wherein the actuator is disposed uphole of the isolation sleeve.

Clause 22. A downhole apparatus, comprising: a completion sleeve having a longitudinal axis, a bore, and a window extending at least partially along the longitudinal axis to provide access to the bore; an isolation sleeve positioned within the bore of the completion sleeve, the isolation sleeve being longitudinally movable within the bore to adjust an amount of longitudinal overlap between the isolation sleeve and the completion sleeve window for permitting or blocking access through the window into the bore; and an actuator operatively coupled to the isolation sleeve, the actuator including a movement member moveably coupling a first clutch and a second clutch, wherein the isolation sleeve passes through the first clutch and the second clutch to move the isolation sleeve within the bore.

Clause 23. The downhole apparatus of Clause 22, wherein the isolation sleeve is movable between a first position, wherein the isolation sleeve occludes the window, and a second position, wherein the isolation sleeve is moved axially within the completion sleeve to expose the window.

Clause 24. The downhole apparatus of Clause 22 or 23, wherein the isolation sleeve further comprises a flow control position between the first position and the second position, wherein in the flow control position the isolation sleeve is moved axially within the completion sleeve to partially expose the window.

Clause 25. The downhole apparatus of any one of Clauses 22-24, wherein the isolation sleeve further comprises a flow control orifice defining the flow control position.

Clause 26. The downhole apparatus of any one of Clauses 22-25, wherein the second clutch is axially disposed relative to the first clutch and the first clutch and the second clutch are configured to receive the isolation sleeve therebetween.

Clause 27. The downhole apparatus of any one of Clauses 22-26, wherein the actuator comprises a hydraulic actuator.

Clause 28. The downhole apparatus of Clause 27, wherein the hydraulic actuator comprises a sequential valve system for actuating to the movement member, the first clutch, and the second clutch.

Clause 29. The downhole apparatus of Clause 27, wherein the hydraulic actuator comprises a closed hydraulic system.

Clause 30. The downhole apparatus of any one of Clauses 22-29, wherein the actuator comprises a pneumatic actuator.

Clause 31. The downhole apparatus of Clause 30, wherein the pneumatic actuator comprises a sequential valve system for actuating to the movement member, the first clutch, and the second clutch.

Clause 32. The downhole apparatus of any one of Clauses 22-31, wherein the isolation sleeve comprises an upper seal to sealingly engage the completion sleeve uphole of the window when the isolation sleeve is blocking access through the window into the bore.

Clause 33. The downhole apparatus of any one of Clauses 22-32, wherein the isolation sleeve comprises a lower seal to sealingly engage the completion sleeve downhole of the window when the isolation sleeve is blocking access through the window into the bore.

Clause 34. The downhole apparatus of any one of Clauses 22-33, further comprising a deflector disposed downhole of the window.

Clause 35. The downhole apparatus of any one of Clauses 22-34, wherein the isolation sleeve comprise an upper seal to sealingly engage the completion sleeve uphole of the window and a lower seal to sealingly engage the completion sleeve downhole of the window when the isolation sleeve is blocking access through the window into the bore.

Clause 36. The downhole apparatus of Clause 35, wherein the actuator is disposed between the upper seal and the lower seal.

Clause 37. The downhole apparatus of any one of Clauses 22-36, wherein the isolation sleeve comprises an actuation profile.

Clause 38. The downhole apparatus of Clause 37, wherein at least one of the first clutch and the second clutch engages the actuation profile.

Clause 39. The downhole apparatus of any one of Clauses 22-38, wherein the isolation sleeve comprises a retrieval profile to engage a retrieval tool.

Clause 40. The downhole apparatus of any one of Clauses 22-39, wherein the actuator is disposed downhole of the isolation sleeve.

Clause 41. The downhole apparatus of any one of Clauses 22-40, wherein the actuator is disposed uphole of the isolation sleeve.

Clause 42. A well system, comprising: a primary wellbore lined with a casing that defines a casing exit; a secondary wellbore extending from the casing exit; and an isolation window assembly positioned within the primary wellbore, the isolation window including: a completion sleeve having a longitudinal axis, a bore, and a window extending at least partially along the longitudinal axis to provide access to the bore; an isolation sleeve positioned within the bore of the completion sleeve, the isolation sleeve being longitudinally movable within the bore to adjust an amount of longitudinal overlap between the isolation sleeve and the completion sleeve window for permitting or blocking access through the window into the bore; and an actuator operatively coupled to the isolation sleeve, the actuator including a movement member moveably coupling a first clutch and a second clutch, wherein the isolation sleeve passes through the first clutch and the second clutch to longitudinally move the isolation sleeve within the bore.

Clause 43. The well system of Clause 42, further comprising a flow control valve disposed within the primary wellbore.

Clause 44. The well system of Clause 42 or 43, wherein the isolation sleeve is movable between a first position, wherein the isolation sleeve occludes the window, and a second position, wherein the isolation sleeve is moved axially within the completion sleeve to expose the window.

Clause 45. The well system of Clause 44, wherein the isolation sleeve further comprises a flow control position between the first position and the second position, wherein in the flow control position the isolation sleeve is moved axially within the completion sleeve to partially expose the window.

Clause 46. The well system of Clause 45, wherein the isolation sleeve further comprises a flow control orifice defining the flow control position.

Clause 47. The well system of any one of Clauses 42-46, wherein the second clutch is axially disposed relative to the first clutch and the first clutch and the second clutch are configured to receive the isolation sleeve therebetween.

Clause 48. The well system of any one of Clauses 42-47, wherein the actuator comprises a hydraulic actuator.

Clause 49. The well system of Clause 47, wherein the hydraulic actuator comprises a sequential valve system for actuating to the movement member, the first clutch, and the second clutch.

Clause 50. The well system of Clause 49, wherein the hydraulic actuator comprises a closed hydraulic system.

Clause 51. The well system of any one of Clauses 42-50, wherein the actuator comprises a pneumatic actuator.

Clause 52. The well system of Clause 51, wherein the pneumatic actuator comprises a sequential valve system for actuating to the movement member, the first clutch, and the second clutch.

Clause 53. The well system of any one of Clauses 42-52, wherein the isolation sleeve comprises an upper seal to sealingly engage the completion sleeve uphole of the window when the isolation sleeve is blocking access through the window into the bore.

Clause 54. The well system of any one of Clauses 42-53, wherein the isolation sleeve comprises a lower seal to sealingly engage the completion sleeve downhole of the window when the isolation sleeve is blocking access through the window into the bore.

Clause 55. The well system of any one of Clauses 42-54, wherein the isolation sleeve comprise an upper seal to sealingly engage the completion sleeve uphole of the window and a lower seal to sealingly engage the completion sleeve downhole of the window when the isolation sleeve is blocking access through the window into the bore.

Clause 56. The well system of Clause 55, wherein the actuator is disposed between the upper seal and the lower seal.

Clause 57. The well system of any one of Clauses 42-56, wherein the isolation sleeve comprises an actuation profile.

Clause 58. The well system of Clause 57, wherein at least one of the first clutch and the second clutch engages the actuation profile.

Clause 59. The well system of any one of Clauses 42-58, further comprising a deflector disposed downhole of the window.

Clause 60. The well system of any one of Clauses 42-59, wherein the isolation sleeve comprises a retrieval profile to engage a retrieval tool.

Clause 61. The well system of any one of Clauses 42-60, wherein the actuator is disposed downhole of the isolation sleeve.

Clause 62. The well system of any one of Clauses 42-61, wherein the actuator is disposed uphole of the isolation sleeve.

Clause 63. The well system of any one of Clauses 42-62, wherein the isolation sleeve further comprises a flow control position between the first position and the second position, wherein in the flow control position the isolation sleeve is moved axially within the completion sleeve to partially expose the window.

Clause 64. The well system of Clause 63, wherein the isolation sleeve further comprises a flow control orifice defining the flow control position.

Clause 65. A method, comprising: providing a casing that defines a casing exit and has a secondary wellbore extending from the casing exit; providing a completion sleeve having a longitudinal axis, a bore, and a window aligned with the casing exit, the window at least partially along the longitudinal axis to provide access to the bore; moving an isolation sleeve axially within the completion sleeve to adjust an amount of longitudinal overlap between the isolation sleeve and the completion sleeve window for permitting or blocking access through the window into the bore via an actuator; and reciprocating the actuator relative to the isolation sleeve to axially move the isolation sleeve.

Clause 66. The method of Clause 65, the actuator comprising a movement member moveably coupling a first clutch and a second clutch, wherein the isolation sleeve passes through the first clutch and the second clutch to permit or block access through the window into the bore.

Clause 67. The method of Clause 66, further comprising: engaging the first clutch against the isolation sleeve; moving the first clutch axially via the movement member to move the isolation sleeve; and releasing the first clutch.

Clause 68. The method of Clause 67, further comprising: engaging the second clutch against the isolation sleeve; moving the second clutch axially via the movement member to move the isolation sleeve; and releasing the second clutch.

Clause 69. The method of any one of Clauses 65-68, wherein the actuator comprises a hydraulic actuator.

Clause 70. The method of Clause 69, wherein the hydraulic actuator comprises a sequential valve system for actuating to the movement member, the first clutch, and the second clutch.

Clause 71. The method of Clause 70, wherein the hydraulic actuator comprises a closed hydraulic system.

Clause 72. The method of any one of Clauses 65-71, wherein the actuator comprises a pneumatic actuator.

Clause 73. The method of Clause 72, wherein the pneumatic actuator comprises a sequential valve system for actuating to the movement member, the first clutch, and the second clutch.

Clause 74. The method of any one of Clauses 65-73, further comprising sealingly engaging the completion sleeve uphole of the window via an upper seal when the isolation sleeve is blocking access through the window into the bore.

Clause 75. The method of any one of Clauses 65-74, further comprising sealingly engaging the completion sleeve downhole of the window via a lower seal when the isolation sleeve is blocking access through the window into the bore.

Clause 76. The method of any one of Clauses 65-75, further comprising sealingly engaging the completion sleeve uphole of the window via an upper seal of the isolation sleeve and downhole of the window via a lower seal when the isolation sleeve is blocking access through the window into the bore.

Clause 77. The method of Clause 76, wherein the actuator is disposed between the upper seal and the lower seal.

Clause 78. The method of any one of Clauses 65-77, wherein the isolation sleeve comprises an actuation profile.

Clause 79. The method of Clause 78, further comprising engaging the actuation profile via at least one of the first clutch and the second clutch.

Clause 80. The method of any one of Clauses 65-79, further comprising deploying a deflector disposed downhole of the window.

Clause 81. The method of any one of Clauses 65-80, further comprising engaging the isolation sleeve with a retrieval tool via a retrieval profile of the isolation sleeve.

Clause 82. The method of any one of Clauses 65-81, wherein the actuator is disposed downhole of the isolation sleeve.

Clause 83. The method of any one of Clauses 65-82, wherein the actuator is disposed uphole of the isolation sleeve.

Clause 84. A method, comprising: providing a completion sleeve in a primary wellbore lined with a casing that defines a casing exit and has a secondary wellbore extending from the casing exit, the completion sleeve having a longitudinal axis, a bore, and a window aligned with the casing exit, the window at least partially along the longitudinal axis to provide access to the bore; and moving an isolation sleeve axially within the completion sleeve to increase or decrease flow through the window via an actuator; and reciprocating the actuator relative to the isolation sleeve to axially move the isolation sleeve.

Clause 85. The method of Clause 84, wherein the isolation sleeve further comprises a flow control orifice to control the amount of flow.

Clause 86. The method of Clause 84 or 85, the actuator comprising a movement member moveably coupling a first clutch and a second clutch, wherein the isolation sleeve passes through the first clutch and the second clutch to move the isolation sleeve to increase or decrease flow through the window Clause 87. The method of Clause 86, further comprising: engaging the first clutch against the isolation sleeve; moving the first clutch axially via the movement member to move the isolation sleeve; and releasing the first clutch.

Clause 88. The method of Clause 87, further comprising: engaging the second clutch against the isolation sleeve; moving the second clutch axially via the movement member to move the isolation sleeve; and releasing the second clutch.

Clause 89. The method of any one of Clauses 84-88, wherein the actuator comprises a hydraulic actuator.

Clause 90. The method of Clause 89, wherein the hydraulic actuator comprises a sequential valve system for actuating to the movement member, the first clutch, and the second clutch.

Clause 91. The method of Clause 89, wherein the hydraulic actuator comprises a closed hydraulic system.

Clause 92. The method of any one of Clauses 84-91, wherein the actuator comprises a pneumatic actuator.

Clause 93. The method of Clause 92, wherein the pneumatic actuator comprises a sequential valve system for actuating to the movement member, the first clutch, and the second clutch.

Clause 94. The method of any one of Clauses 84-93, further comprising sealingly engaging the completion sleeve uphole of the window via an upper seal of the isolation sleeve.

Clause 95. The method of any one of Clauses 84-94, further comprising sealingly engaging the completion sleeve downhole of the window via a lower seal of the isolation sleeve.

Clause 96. The method of any one of Clauses 84-95, further comprising sealingly engaging the completion sleeve uphole of the window via an upper seal of the isolation sleeve and downhole of the window via a lower seal of the isolation sleeve.

Clause 97. The method of Clause 96, wherein the actuator is disposed between the upper seal and the lower seal.

Clause 98. The method of any one of Clauses 84-97, wherein the isolation sleeve comprises an actuation profile.

Clause 99. The method of Clause 98, further comprising engaging the actuation profile via at least one of the first clutch and the second clutch.

Clause 100. The method of any one of Clauses 84-99, further comprising engaging the isolation sleeve with a retrieval tool via a retrieval profile of the isolation sleeve.

Clause 101. The method of any one of Clauses 84-100, wherein the actuator is disposed downhole of the isolation sleeve.

Clause 102. The method of any one of Clauses 84-101, wherein the actuator is disposed uphole of the isolation sleeve.

What is claimed is:

1. A lateral wellbore access system for moving an isolation sleeve relative to a window of a completion sleeve to adjust access through the window, comprising:

an actuator having an isolation sleeve engagement mechanism and a driving mechanism, the isolation sleeve engagement mechanism configured to engage with the isolation sleeve, wherein the isolation sleeve comprises an actuation profile operable to engage the isolation sleeve engagement mechanism, the driving mechanism configured to longitudinally reciprocate the isolation sleeve relative to the isolation sleeve engagement mechanism within a bore of the completion sleeve to longitudinally move the isolation sleeve within the bore relative to a window of the completion sleeve to adjust a position of the isolation sleeve relative to the completion sleeve window for permitting or blocking access through the window into the bore, the isolation sleeve operable to shift without manipulation from a tool extending from an above-ground location, wherein the isolation sleeve is operable to move without overall positional displacement of the actuator.

2. The lateral wellbore access system of claim 1, further comprising the completion sleeve having a longitudinal axis, a bore, and a window extending at least partially along the longitudinal axis to provide access to the bore.

3. The lateral wellbore access system of claim 1, further comprising the isolation sleeve positioned within the bore of the completion sleeve, the isolation sleeve being longitudinally movable within the bore to adjust an amount the position of the isolation sleeve relative to the completion sleeve window for permitting or blocking access through the window into the bore a first position, wherein the isolation sleeve occludes the window, and a second position, wherein the isolation sleeve is moved axially within the completion sleeve to expose the window.

4. The lateral wellbore access system of claim 3, wherein the isolation sleeve comprise an upper seal to sealingly engage the completion sleeve uphole of the window and a lower seal to sealingly engage the completion sleeve downhole of the window when the isolation sleeve blocks access through the window into the bore.

5. The lateral wellbore access system of claim 4, wherein the actuator is disposed between the upper seal and the lower seal.

6. The lateral wellbore access system of claim 1, wherein the driving mechanism comprises a hydraulic driving mechanism.

7. The lateral wellbore access system of claim 1, wherein the actuator comprises a pneumatic actuator.

8. The lateral wellbore access system of claim 1, wherein the actuator comprises a hydraulic actuator.

9. A lateral wellbore access system for moving an isolation sleeve relative to a window of a completion sleeve to adjust access through the window, comprising:

an actuator having an isolation sleeve engagement mechanism and a driving mechanism, the isolation sleeve engagement mechanism configured to engage with the isolation sleeve, the driving mechanism configured to longitudinally reciprocate the isolation sleeve relative to the isolation sleeve engagement mechanism within a bore of the completion sleeve to longitudinally move the isolation sleeve within the bore relative to a window of the completion sleeve to adjust a position of the isolation sleeve relative to the completion sleeve window for permitting or blocking access through the window into the bore, wherein the isolation sleeve engagement mechanism comprises a first clutch and a second clutch, and the driving mechanism movably couples the first clutch and the second clutch.

10. The lateral wellbore access system of claim 9, wherein the isolation sleeve passes through the first clutch and the second clutch to adjust the position of the isolation sleeve relative to the completion sleeve.

11. The lateral wellbore access system of claim 10, wherein the second clutch is axially disposed relative to the first clutch and the first clutch and the second clutch are configured to receive the isolation sleeve therebetween.

12. A lateral wellbore access system for moving an isolation sleeve relative to a window of a completion sleeve to adjust access through the window, comprising:

an actuator having an isolation sleeve engagement mechanism and a driving mechanism, the isolation sleeve engagement mechanism configured to engage with the isolation sleeve, the driving mechanism configured to longitudinally reciprocate the isolation sleeve relative to the isolation sleeve engagement mechanism within a bore of the completion sleeve to longitudinally move the isolation sleeve within the bore relative to a window of the completion sleeve to adjust a position of the isolation sleeve relative to the completion sleeve window for permitting or blocking access through the window into the bore, wherein the driving mechanism comprises a hydraulic driving mechanism, wherein the hydraulic driving mechanism comprises a sequential valve system for actuating a movement member, a first clutch, and a second clutch.

13. The lateral wellbore access system of claim 12, wherein the isolation sleeve is operable to move without overall positional displacement of the actuator.

14. A lateral wellbore access system for moving an isolation sleeve relative to a window of a completion sleeve to adjust access through the window, comprising:

an actuator having an isolation sleeve engagement mechanism and a driving mechanism, the isolation sleeve engagement mechanism configured to engage with the isolation sleeve, the driving mechanism configured to longitudinally reciprocate the isolation sleeve relative to the isolation sleeve engagement mechanism within a bore of the completion sleeve to longitudinally move the isolation sleeve within the bore relative to a window of the completion sleeve to adjust a position of the isolation sleeve relative to the completion sleeve window for permitting or blocking access through the window into the bore, wherein the isolation sleeve comprises an actuation profile, wherein at least one of a first clutch and a second clutch engages the actuation profile.

15. A well system, comprising:

a primary wellbore lined with a casing that defines a casing exit;

a secondary wellbore extending from the casing exit; and an isolation window assembly positioned within the primary wellbore, the isolation window including:

a completion sleeve having a longitudinal axis, a bore, and a window extending at least partially along the longitudinal axis to provide access to the bore;

an isolation sleeve positioned within the bore of the completion sleeve, the isolation sleeve being longitudinally movable within the bore to adjust a position of the isolation sleeve relative to the completion sleeve window for permitting or blocking access through the window into the bore; and an actuator operatively coupled to the isolation sleeve, the actuator including a movement member moveably coupling a first clutch and a second clutch, wherein the isolation sleeve passes through the first clutch and the second clutch to longitudinally move the isolation sleeve within the bore.

16. The well system of claim 15, wherein the second clutch is axially disposed relative to the first clutch and the first clutch and the second clutch are configured to receive the isolation sleeve therebetween.

17. A method, comprising:

providing a casing that defines a casing exit and has a secondary wellbore extending from the casing exit;

providing a completion sleeve having a longitudinal axis, a bore, and a window aligned with the casing exit, the window at least partially along the longitudinal axis to provide access to the bore; and engaging an actuation profile of an isolation sleeve with an isolation sleeve engagement mechanism of an actuator to move the isolation sleeve axially within the completion sleeve to adjust a position of the isolation sleeve relative to the completion sleeve window for permitting or blocking access through the window into the bore, wherein the isolation sleeve is operable to move without overall positional displacement of the actuator.

18. A method, comprising:

providing a casing that defines a casing exit and has a secondary wellbore extending from the casing exit;

providing a completion sleeve having a longitudinal axis, a bore, and a window aligned with the casing exit, the window at least partially along the longitudinal axis to provide access to the bore;

moving an isolation sleeve axially within the completion sleeve to adjust a position of the isolation sleeve relative to the completion sleeve window for permitting or blocking access through the window into the bore via an actuator; and reciprocating the actuator relative to the isolation sleeve to axially move the isolation sleeve, the actuator comprising a movement member moveably coupling a first clutch and a second clutch, wherein the isolation sleeve passes through the first clutch and the second clutch to permit or block access through the window into the bore.

19. The method of claim 18, further comprising:

engaging the first clutch against the isolation sleeve;

moving the first clutch axially via the movement member to move the isolation sleeve; and releasing the first clutch.

20. The method of claim 19, further comprising:

engaging the second clutch against the isolation sleeve;

moving the second clutch axially via the movement member to move the isolation sleeve; and releasing the second clutch.

* * * * *